US005752472A

United States Patent [19]

Jubinville et al.

[11] Patent Number: 5,752,472

[45] Date of Patent: May 19, 1998

[54] APPARATUS FOR RESTRAINING RUMINANT MAMMALS

[76] Inventors: Leonard Arthur Jubinville; Gisele Jubinville, both of R.R. #2, St. Albert, Alberta, Canada, T8N 1M9

[21] Appl. No.: 699,344

[22] Filed: Aug. 19, 1996

[51] Int. Cl.[6] ..... A61D 3/00

[52] U.S. Cl. ..... 119/728; 452/54

[58] Field of Search ..... 119/728, 751, 119/754, 756; 452/53, 54, 56

[56] References Cited

U.S. PATENT DOCUMENTS

| | | | |
|---|---|---|---|
| 3,027,594 | 4/1962 | Moss | 452/53 |
| 3,112,519 | 12/1963 | Hlavacek et al. | 452/54 |
| 3,115,670 | 12/1963 | Hlavacek et al. | 452/54 |

FOREIGN PATENT DOCUMENTS

| | | | |
|---|---|---|---|
| 1261722 | 1/1972 | United Kingdom | 119/728 |

*Primary Examiner*—Robert P. Swiatek
*Assistant Examiner*—Yvonne R. Abbott
*Attorney, Agent, or Firm*—Anthony R. Lambert

[57] ABSTRACT

An apparatus for restraining ruminant mammals; especially deer. The apparatus includes a "V" shaped open ended chute having opposed sidewalls and a floor. Shoulder pads are secured in opposed relation to the opposed sidewalls adjacent one open end. The shoulder pads engage shoulders of an animal attempting to pass through chute, thereby retarding the animals forward progress. Relative movement of the sidewalls and the floor is effected, thereby suspending the animal in the "V" shaped open ended chute.

6 Claims, 4 Drawing Sheets

APPARATUS FOR RESTRAINING RUMINANT MAMMALS

NAMES OF INVENTORS:

Leonard Arthur Jubinville

Gisele Jubinville

FIELD OF THE INVENTION

The present invention relates to an apparatus for restraining ruminant mammals and, in particular, deer.

BACKGROUND OF THE INVENTION

A variety of apparatus have been developed for restraining ruminant mammals. One early form of such an apparatus is referred to as a "squeeze". This apparatus is an enclosure large enough to accommodate one animal. The name "squeeze" is derived from the fact that the side walls of the enclosure move inwardly, thereby squeezing the animal. The disadvantage of using a squeeze is that it is difficult to gauge the amount of pressure required to properly restrain the animal. This increases the possibility of the animal being injured or stressed. It also does not provide access to the head, neck, ears and antlers of the animal that a deer handler requires.

The preferred type of apparatus used to restrain deer is a "V" shaped enclosure. There are two common types of "V" shaped enclosures. One type is the "raised wall" type, which raises the animal away from the floor, thereby suspending the animal in the "V" shape walls of the enclosure. The other type is the "drop floor" type which drops the floor from under the animal, thereby suspending the animal in the "V" shape walls of the enclosure. The versions of these apparatus that currently are commercially available have some drawbacks. They have solid end gates. Deer are reluctant to enter such enclosures when they cannot see a means for escape. Once in the "V" shaped enclosure, the animal works its way to the front until it is stopped at the solid end gate. The animal often moves so far forward that it's neck is bent at an angle. This is stressful to the animal and makes it difficult for the operator to access the head, neck, ears and antlers of the animal. In order to encourage the animal to enter the disclosure and provide better access to the head, neck, ears and antlers of the animal; a number of these apparatus have end gates which have an access opening. This access opening in the end gate, while addressing the problems described, has created other more serious problems. It has been determined that the access opening is a potential hazard. The access opening is not always large enough to accommodate the deer's set of antlers. Deer have been injured attempting to thrust their head through an opening that is not quite large enough to accommodate them. The Deer have a remarkable ability to leap. Deer have been injured when their front feet got caught in the access opening when they attempted to leap through such opening.

SUMMARY OF THE INVENTION

What is required is a restraint apparatus that is better suited for use with deer, and other animals with broad antlers.

According to the present invention there is provided an apparatus for restraining ruminant mammals, which includes a "V" shaped open ended chute having opposed sidewalls and a floor. Shoulder engaging means are secured in opposed relation to the opposed sidewalls adjacent one open end. The shoulder engaging means engage shoulders of an animal attempting to pass through chute, thereby retarding the animals forward progress. Means are provided for effecting relative movement of the sidewalls and the floor, thereby suspending the animal in the "V" shaped open ended chute.

With the apparatus, as described above, the forward progress of the animal is retarded by the shoulder engaging means. This form of restraint leaves the head, neck, ears and antlers of the animal accessible to the operator. The preferred form of shoulder engaging means are pads that project inwardly from each of the opposed sidewalls.

Although beneficial results may be obtained through the use of the shoulder pads, as described above, it has been found that animals endeavour to attempt to leap over the shoulder pads. Even more beneficial effects may, therefore, be obtained when a blind obstructs a top half of the chute adjacent to the shoulder engaging means. The animal behaves as if the blind were a solid wall. The animal does not attempt to leap, but instead ducks under the blind. In doing so, the animal moves into the desired position engaging the shoulder pads. The preferred form of blind is a curtain. A curtain will not cause injury if the animal does not duck low enough.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
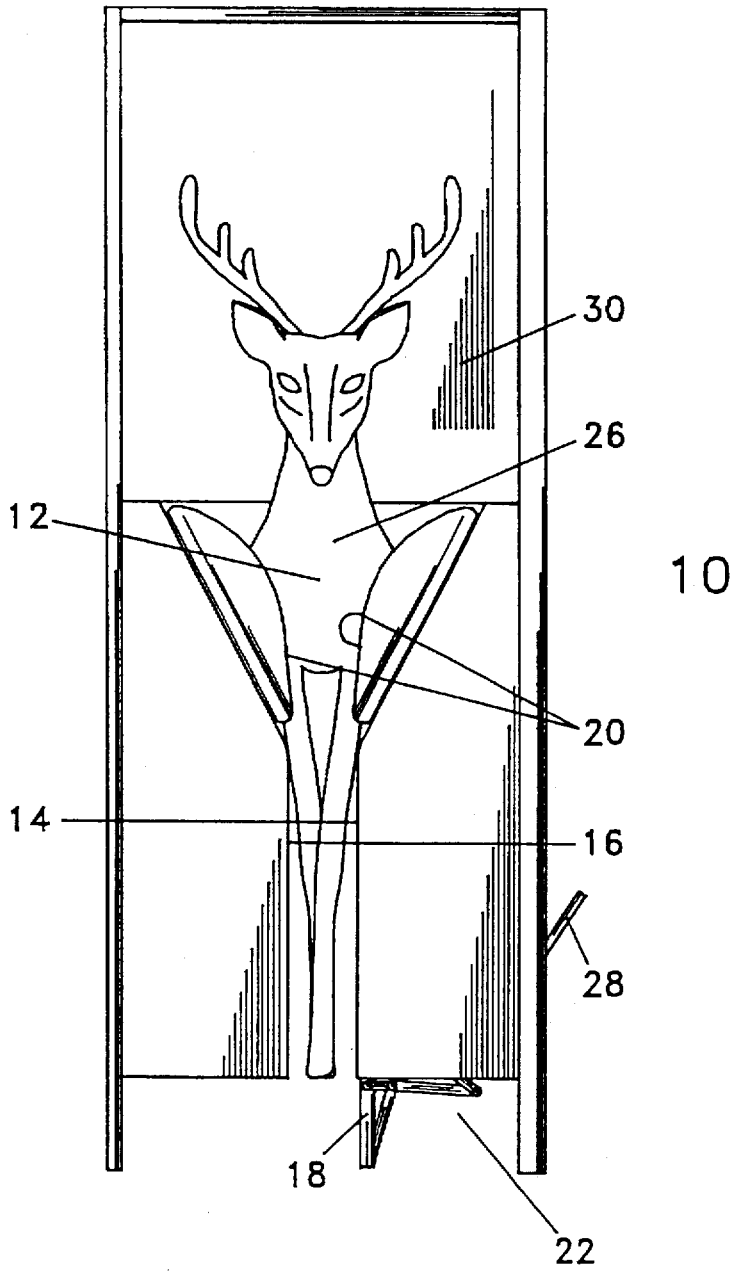
FIG. 1 is a front end elevation view of an apparatus for restraining ruminant mammals constructed in accordance with the teachings of the present invention, showing the manner in which a deer is suspended.

The preferred embodiment, an apparatus for restraining ruminant mammals generally identified by reference numeral 10, will now be described with reference to FIGS. 1 through 4.

Figure 2:
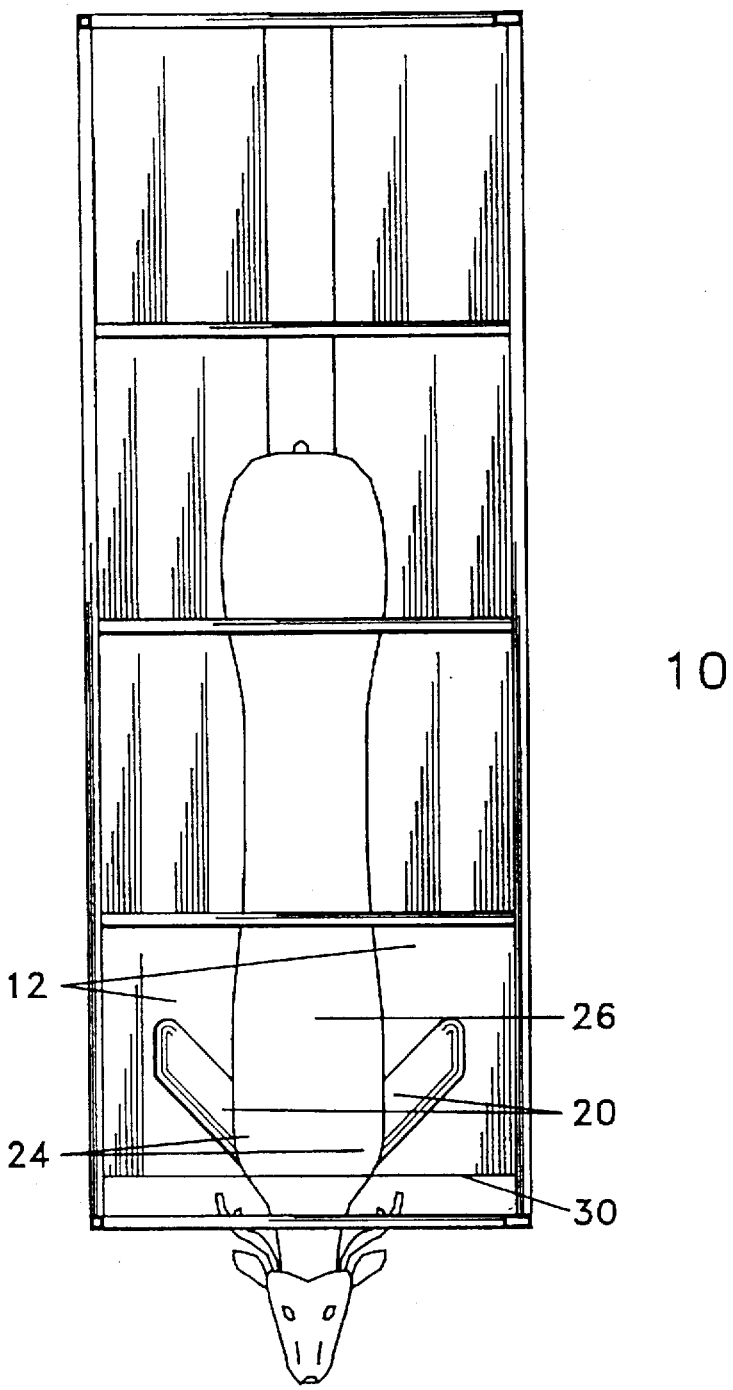
FIG. 2 is a top plan view of the apparatus illustrated in FIG. 1.
Figure 3:
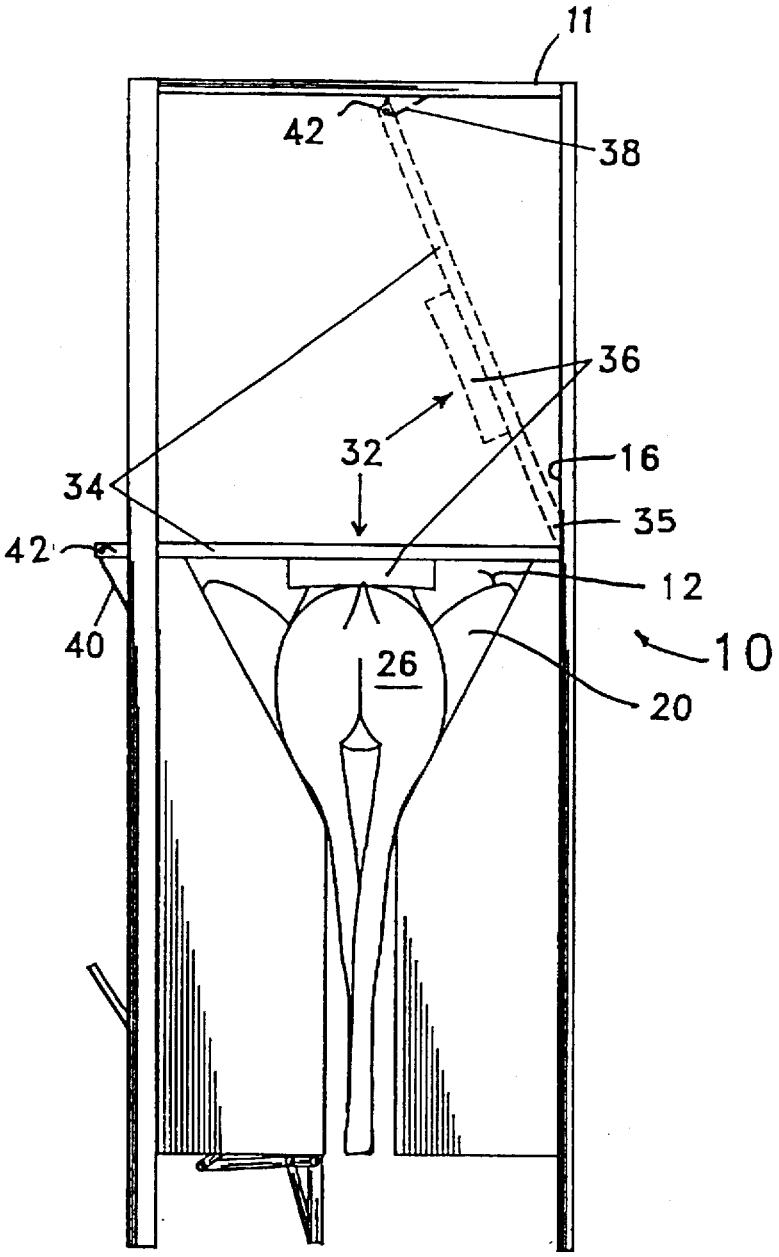
FIG. 3 is a rear end elevation view of the apparatus illustrated in FIG. 1.
Figure 4:
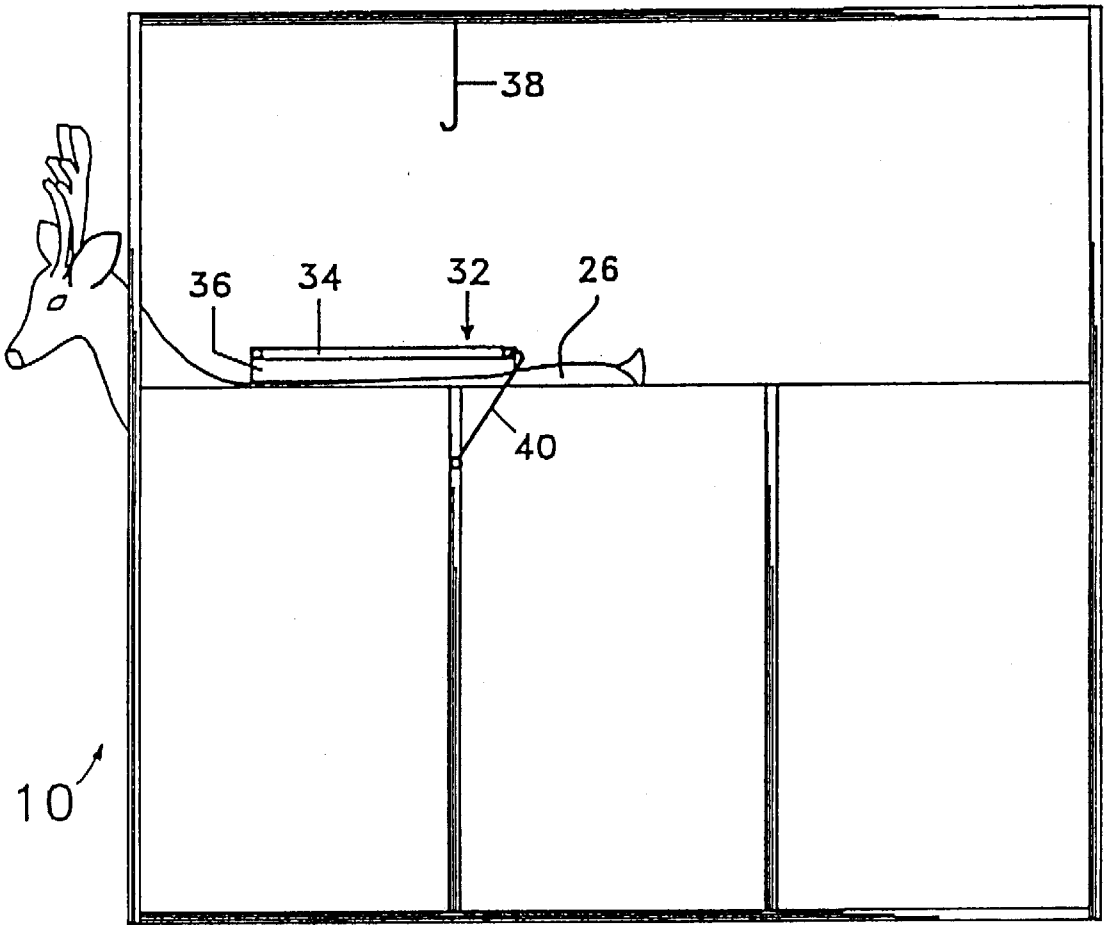
FIG. 4 is a side elevation view of the apparatus illustrated in FIG. 1.

Referring to FIG. 1, apparatus 10 is a "V" shaped open ended chute 12 having opposed sidewalls 14 and 16 and a floor 18. Pads 20 projecting inwardly in opposed relation from each of opposed sidewalls 14 and 16 adjacent one open end 22. Referring to FIG. 2, pads 20 engage shoulders 24 of an animal, such as a deer 26, attempting to pass through open ended chute 12, thereby retarding the forward progress of deer 26. Referring to FIG. 1, a mechanical actuator 28 is provided for effecting relative movement of sidewalls 14 and 16 and floor 18. In this particular embodiment, mechanical actuator 28 lowers floor 18, thereby suspending deer 26 in "V" shaped chute 12. It will be appreciated that mechanical actuator 28 can be made in the form of a treadle which is activated when deer 26 steps upon it. A curtain 30 is positioned to obstruct a top half of "V" shaped chute 12 immediately adjacent to pads 20. Referring to FIG. 3, a movable pressure member 32 is provided having a first end 34 and a second end 35. Second end 35 is pivotally secured to sidewall 16 above the level of "V" shaped chute 12. Pressure member 32 is movable between a raised and a lowered position. In the lowered position downward pressure can be applied to restrain deer 26. A pad 36 is mounted onto pressure member 32, so as to avoid injury to deer 26. Two hooks 38 and 40 are attached to superstructure 11 of apparatus 10. Hook 38 is positioned at the raised position for pressure member 32. Hook 40 is positioned at the lowered position for pressure member 32. Pressure member 32 can be locked in a selected position by extending either hook 38 or hook 40 through an aperture 42 which is positioned at first end 34 of pressure member 32.

The use and operation of apparatus 10 will now be described with reference to FIGS. 1 and 2. Referring to FIG. 2, deer 26 is directed into "V" shaped open ended chute 12. Referring to FIG. 1, deer 26 sees light from below curtain 30 and moves toward it. The presence of curtain 30 influences how aggressively deer 26 moves toward the light and serves as a deterrent to the deer attempting to leap over shoulder pads 20. Deer 26 ducks under curtain 30 and continues forward until its forward progress is retarded by shoulders 24 engaging pads 20, as illustrated in FIG. 2. Referring to FIG. 1, floor 18 is dropped down by means of actuators 28, to suspend deer 26 in "V" shaped chute 12. If, despite all of the above described precautions, deer 26 becomes skittish; pressure member is lowered and locked in position by extending hook 40 through aperture 42. This physically restrains deer 26 making it difficult, if not impossible, for it to jump over shoulder pads 20.

While shoulder pads 20 can be built into the sidewalls, it is preferred that they be detachable. When they are detachable, shoulder pads can be placed at either end of chute 12. This allows apparatus 10 to be made "left handed" or "right handed" merely by switching the end at which animal enters and the end at which the shoulder pads are located.

It will be apparent to one familiar with handling deer the advantages that apparatus 10 provides in terms of access for the operator and reducing stress upon the animal. It will also be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. An apparatus for restraining ruminant mammals, comprising:

a "V" shaped open ended chute having opposed sidewalls and a floor;

shoulder engaging means secured in opposed relation to the opposed sidewalls adjacent one open end, such that the shoulder engaging means engage shoulders of an animal attempting to pass through chute thereby retarding the animals forward progress; and means for effecting relative movement of the sidewalls and the floor, thereby suspending the animal in the "V" shaped open ended chute.

2. The apparatus as defined in claim 1, wherein the shoulder engaging means are pads that project inwardly from each of the opposed sidewalls.

3. The apparatus as defined in claim 1, wherein a detachable blind obstructs a top half of the chute immediately adjacent to the shoulder engaging means.

4. The apparatus as defined in claim 3, wherein the detachable blind is in the form of a curtain.

5. The apparatus as defined in claim 1, wherein the means for effecting relative movement of the sidewalls and the floor is to drop the floor.

6. An apparatus for restraining ruminant mammals, comprising:

a "V" shaped open ended chute having opposed sidewalls and a floor;

pads projecting inwardly in opposed relation from each of the opposed sidewalls adjacent one open end, such that the pads engage shoulders of an animal attempting to pass through chute thereby retarding the animal's forward progress; means for dropping the floor; thereby suspending the animal in the "V" shaped open ended chute; and a curtain obstructing a top half of the chute immediately adjacent to the pads.

* * * * *